US011333473B2

(12) United States Patent
Carper et al.

(10) Patent No.: US 11,333,473 B2
(45) Date of Patent: May 17, 2022

(54) LONG CARTRIDGE CASE

(71) Applicant: National Machinery LLC, Tiffin, OH (US)

(72) Inventors: Jeffrey W. Carper, Tiffin, OH (US); Christopher W. Snavely, Republic, OH (US)

(73) Assignee: NATIONAL MACHINERY LLC, Tiffin, OH (US)

( * ) Notice: Subject to any disclaimer, the term of this patent is extended or adjusted under 35 U.S.C. 154(b) by 426 days.

(21) Appl. No.: 16/661,058

(22) Filed: Oct. 23, 2019

(65) Prior Publication Data

US 2020/0056870 A1 Feb. 20, 2020

Related U.S. Application Data

(62) Division of application No. 15/451,717, filed on Mar. 7, 2017, now Pat. No. 10,495,430.

(51) Int. Cl.

| | |
|---|---|
| ***B21K 21/04*** | (2006.01) |
| ***F42B 33/00*** | (2006.01) |
| ***B21C 23/21*** | (2006.01) |
| ***B21C 23/20*** | (2006.01) |
| ***F42B 5/02*** | (2006.01) |
| ***B21C 23/18*** | (2006.01) |
| ***F42B 5/28*** | (2006.01) |

(52) U.S. Cl.

CPC ..... *F42B 33/00* (2013.01); *B21C 23/186* (2013.01); *B21C 23/205* (2013.01); *B21C 23/217* (2013.01); *B21C 23/218* (2013.01); *B21K 21/04* (2013.01); *F42B 5/02* (2013.01); *F42B 5/28* (2013.01)

(58) Field of Classification Search

CPC ..... B21K 21/04

See application file for complete search history.

(56) References Cited

U.S. PATENT DOCUMENTS

| | | | | |
|---|---|---|---|---|
| 159,883 | A * | 2/1875 | Bayliss | B21K 21/04 12/139 |
| 2,183,637 | A | 12/1939 | Biginelli | |
| 2,663,068 | A | 12/1953 | Towner | |
| 2,748,464 | A | 6/1956 | Kaul | |
| 2,891,298 | A | 6/1959 | Kaul | |
| 3,103,170 | A | 9/1963 | Covington | |

(Continued)

FOREIGN PATENT DOCUMENTS

| | | |
|---|---|---|
| GB | 892749 | 3/1962 |
| GB | 2056327 A | 3/1981 |

(Continued)

OTHER PUBLICATIONS

National Machinery Drawing: Progressive forming of pistol cartridge case.

*Primary Examiner* — Reginald S Tillman, Jr.

(74) *Attorney, Agent, or Firm* — Pearne & Gordon LLP

(57) ABSTRACT

A method and tooling for forming a cartridge case blank comprising backward extruding a tube from a length of wire stock in multiple backward extrusion steps with progressive tooling to obtain an intermediate blank that can be finish drawn without a preceding annealing step and which if otherwise not subjected to multiple backward extrusion steps, would require annealing prior to finish drawing to avoid tearing.

3 Claims, 2 Drawing Sheets

(56) References Cited

U.S. PATENT DOCUMENTS

| | | | | | |
|---|---|---|---|---|---|
| 3,706,118 | A | | 12/1972 | Hilton et al. | |
| 3,786,755 | A | * | 1/1974 | Eckstein | B29C 66/5344 102/467 |
| 4,166,373 | A | | 9/1979 | Braun | |
| 4,198,843 | A | | 4/1980 | Spence | |
| 4,249,408 | A | | 2/1981 | Lovell | |
| 4,296,536 | A | * | 10/1981 | Hicke | B21D 51/54 86/19.5 |
| 4,416,139 | A | | 11/1983 | Hesse | |
| 4,455,725 | A | | 6/1984 | van Baal | |
| 4,898,017 | A | | 2/1990 | Hite | |
| 5,095,731 | A | * | 3/1992 | Greslin | B21J 13/08 86/19.5 |
| 5,130,207 | A | | 7/1992 | Nelson | |
| 5,507,232 | A | | 4/1996 | Valdez | |
| 5,737,959 | A | | 4/1998 | Korbel | |
| 5,964,117 | A | | 10/1999 | Holroyd | |
| 6,189,199 | B1 | | 2/2001 | Ouchi | |
| 7,334,312 | B2 | | 2/2008 | Bucholtz | |
| 9,016,184 | B2 | | 4/2015 | Hay et al. | |
| 9,134,103 | B1 | | 9/2015 | Harvey | |
| 9,388,714 | B2 | | 7/2016 | Janowiak | |
| 2005/0235543 | A1 | | 10/2005 | Murello | |
| 2014/0083319 | A1 | | 3/2014 | Hay | |
| 2014/0298979 | A1 | | 10/2014 | Neugebauer | |
| 2016/0214156 | A1 | * | 7/2016 | Pilon | B21C 26/00 |

FOREIGN PATENT DOCUMENTS

| | | | | | |
|---|---|---|---|---|---|
| RU | 2113309 | C1 | | 6/1998 | |
| RU | 2313416 | C2 | | 12/2007 | |
| RU | 2446908 | C2 | | 4/2012 | |
| RU | 2451573 | C2 | | 5/2012 | |
| WO | WO-2016100675 | A2 | * | 6/2016 | B21C 1/26 |

* cited by examiner

LUBRICANT TRAP AND REDUCED SURFACE FRICTION ZONES
START DRAW
3RD BACK EXT
2ND BACK EXT
1ST BACK EXT
FULLY DRAWN
FULLY DRAWN
DIA
L

LONG CARTRIDGE CASE

BACKGROUND OF THE INVENTION

The invention relates to the manufacture of cartridge cases.

PRIOR ART

Brass cases for firearm cartridges are conventionally made in numerous steps and on successive machines. Traditionally, cases are formed from brass strip stock that is cupped and then drawn in multiple stages. Annealing steps between the drawing stages are ordinarily required, especially where relatively long cases, such as rifle cases, are being manufactured. The strip stock method produces a high scrap ratio, requires energy for annealing, is slow and prone to dimensional variability, and occupies considerable floor space.

It is known to cold form hollow thin wall intermediate blanks for cartridge cases from solid wire. This process reduces scrap and, when applied to relatively short cartridge cases, can potentially eliminate a need to anneal the blank.

Relatively long cartridge cases, for example those having a length greater than 2½ times their diameter, can require in prior art practice, at least one, if not many, annealing steps before the case can be finally drawn. Without adequate prior annealing, the case tube wall can tear during a draw operation because of work hardening developed during a previous draw or draws. Annealing procedures increase the cost of manufacture, which includes that associated with equipment, energy, time delay, and labor.

SUMMARY OF THE INVENTION

The invention provides a method and tooling for forming relatively long, thin wall cartridge case blanks from wire stock without an intermediate annealing step. The invention utilizes a set of progressive tools in a cold forming machine to backward extrude the blank tube in multiple steps. It has been discovered that work hardening of the blank tube wall can be reduced using the multiple backward extrusion technique. Consequently, a fully drawn tube wall thickness can be obtained without requiring a prior annealing step or steps of the blank.

The inventive technique reduces work hardening in the blank tube wall from what occurs in prior art multiple draw practice. The invention limits the plastic strain or deformation to only the section of tube wall length formed in a single backward extrusion step. A tube wall length section previously extruded is not further deformed and work hardened when a subsequent length section is backward extruded. The inventive technique thus achieves a long cartridge case blank that can be finish drawn to a tube wall thickness that heretofore required annealing between conventional drawing processes.

DESCRIPTION OF THE PREFERRED EMBODIMENT

Figures 1A, 1B, 1C, 1D, 1E, 2:
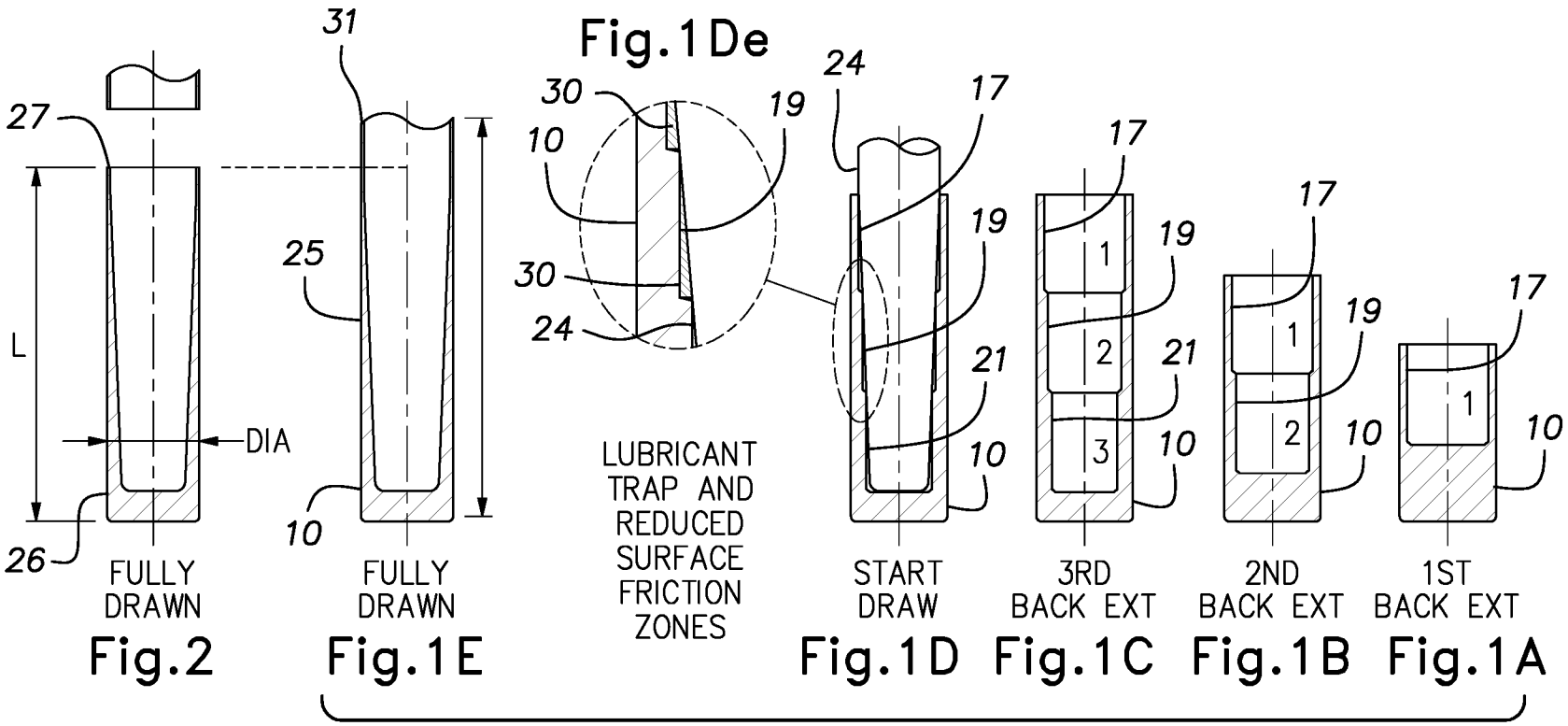
FIGS. 1A-1E diagrammatically illustrate a cartridge case blank forming process embodying the invention.
FIG. 2 is a cross-sectional view of a fully drawn cartridge case blank that has been trimmed to a desired length.

Following is a description, with reference alternatively between FIGS. 1A-1E and FIG. 3 of basic process steps used in the manufacture of a cartridge case blank 10. An initial blank 10 is cut from wire stock 11 by a shear at a cutoff station 12 (FIG. 3) of a progressive cold forming machine 14. The machine 14 is of a construction known in the industry, shown, for example, in U.S. Pat. No. 4,898,017, and discussed in greater detail below. The initial blank 10 has the shape of a solid cylinder ordinarily with minor distortion at its sheared end faces. Typically, the wire stock 11 is brass, although other alloys and metals can be used. An example of a suitable brass is CDA 260. The blank 10 is transferred to a workstation shown as a first workstation 16 where it is backward extruded to produce a tube length section 17 (FIG. 1A) of about ⅓ of a final pre-drawn tube length. The blank 10 is then transferred to a second or subsequent workstation 18 where it is backward extruded to add another length section 19 of a length of about ⅓ of a final pre-drawn tube length and with an inside diameter smaller than the inside diameter of the first length section 17. Thereafter, the blank 10 is transferred to a third or subsequent workstation 20 where it is backward or reverse extruded a third time to add a length section 21 of about ⅓ of a final pre-drawn tube length with an inside diameter smaller than that of the preceding length section 19. The blank 10 can be transferred to a fourth or subsequent workstation 22 where it can be finish drawn through two draw dies 23 with a draw punch 24 or mandrel to a finished wall thickness of preferably about 0.2 mm to about 0.5 mm and more preferably about 0.3 mm measured where the blank tube designated 25 is to be trimmed to form a mouth 27 (FIG. 2).

Preferably, in accordance with the invention, after multiple backward extrusion steps, only one drawing step need be performed on a blank to reach a final or finished wall thickness and pre-trim length in the tube section 25 as shown in FIG. 1E. The blank 10, as described, is drawn to a final non-trimmed tube length and tube wall thickness dimension prior to any bottling (necking) and tapering without requiring an annealing step or steps. By way of example, a single annealing procedure can require a brass blank to be heated to 500-700 degrees F. for 30-45 minutes or more, for instance, to relieve an existing work hardened condition and then require a suitable cooling off period.

Traditionally, a cartridge case has a tapered inside diameter associated with a tube wall thickness that reduces away from a cartridge head 26 towards the open end. The draw punch 24, as is conventional, may have a tapered profile that matches the finished interior profile of the cartridge case. An aspect of the invention involves shaping the stages of the backward extruded sections 17, 19, 21 of the blank tube 25 so that the transition lines or steps from one diameter to the next preferably lie in close proximity to the profile of the draw punch 24 (and ultimately the complementary varying inside diameter of the drawn casing blank tube 25). This preferred arrangement is depicted in FIGS. 1D and 1De, the latter being an enlargement of the drawing area indicated in FIG. 1D. When the draw tool or punch 24 is first seated in the backward extruded sections 17, 19, 21 as shown in FIG. 1D, two beneficial conditions exist. Lubricant 30 is trapped in the clearance spaces between the tool 24 and blank 10. Surface friction is reduced by the small local areas of contact between the blank inside surface and the tool 24 preceding relative movement of the draw dies 23 over the tube wall and tool 24. These conditions are favorable to the drawing operation by reducing forces between the draw dies 23 and the blank tube section 25 and thereby reducing the tendency of the blank tube section to tear.

FIG. 1E illustrates a drawn cartridge case 10 with a characteristic irregular edge 31 at its open end. FIG. 2 illustrates the drawn cartridge case blank 10 after the irregular edge 31 has been trimmed away producing an L/D (diameter) ratio of typically at least 3. Ordinarily, as mentioned, the wall thickness of a blank measured at a trimmed end of the tube section 25 will be about 0.4 mm or less. Preferably, the length of the tube section trimmed away is not more than about ⅛ of the remaining trimmed length L.

Figure 3:
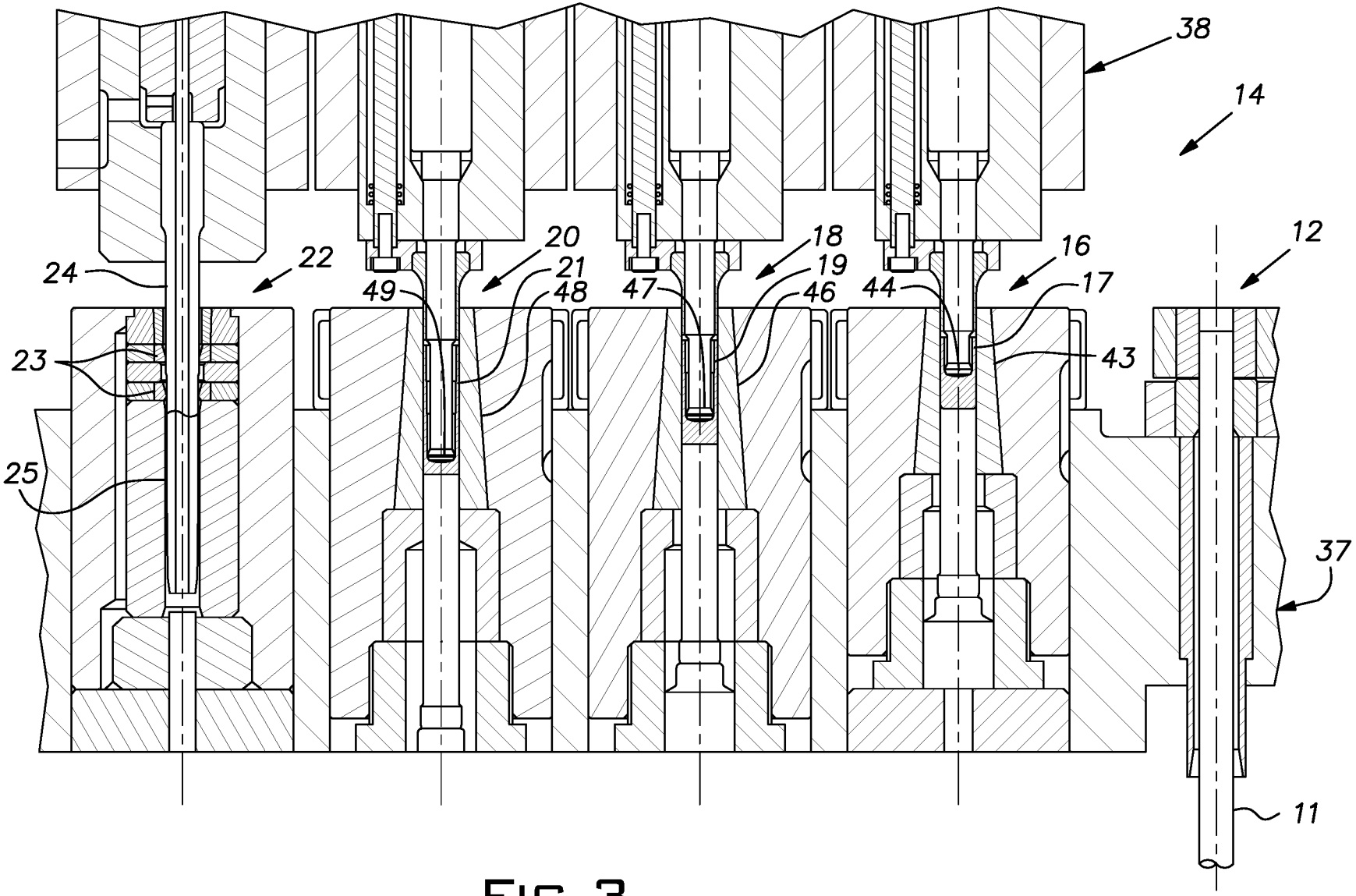
FIG. 3 illustrates exemplary tooling employed in a progressive cold forming machine to perform the process depicted in FIGS. 1A-1E.

FIG. 3 is a diagrammatic representation of the progressive cold forming machine 14 in plan view in which tooling, outlined above, for practicing the invention is mounted. The machine 14 includes a stationary bolster or die breast schematically indicated at 37 and a ram or slide schematically illustrated at 38. The ram 38 reciprocates towards and away from the die breast 37 and is shown at front dead center, closest to the die breast, in FIG. 3. Wire stock 11 is fed to the cutoff station 12 where a length of stock is sheared to form the blank 10. The four workstations 16, 18, 20, 22 are shown to the left of the cutoff station 12. As is known in the industry, the blank 10 is successively transferred from station-to-station by a transfer mechanism (not shown) during cyclic periods that the ram 38 is away from the die breast 37.

At the first station 16, the blank 10, received in a die 43 that is slightly larger (e.g. 0.02-0.05 mm) in diameter than the blank, is backward extruded by a punch 44 of a first diameter to produce the first tube length section 17 with an inside diameter determined by the punch. Typically, at each backward extrusion, the blank outside diameter will grow radially to essentially the inside diameter of the associated die. The punch and die tools 44, 43, can be sized and otherwise configured to produce a tube wall thickness of, by way of example, between about 0.5 mm and about 1 mm in the first section 17.

At the second station 18, the blank 10 is received in a die 46 and is backward extruded by a punch 47. The die 46 preferably has an inside diameter slightly larger (e.g. 0.02-0.05 mm) than the outside diameter of the blank 10 being received from the previous or first station 16. The diameter of the punch 47 is somewhat less than that of the first punch 44 preferably so as to closely follow the geometry of the draw punch. The die 46 and punch 47 are arranged for the blank to be backward extruded to form the tube wall section 19 having an inside diameter somewhat smaller than that of the first-formed wall section 17, as determined by the punch 47, and a length again about ⅓ of a pre-drawn tube length. At the third station 20, the blank is received in a die 48 and is backward extruded by a punch 49. As before, the die 48 preferably has an inside diameter slightly larger (e.g. 0.02-0.05 mm) than the outside diameter of the blank received from the preceding station 18. The diameter of the punch 49 is somewhat less than that of the preceding punch 47 as described previously to preferably closely follow the geometry of the draw punch. The die 48 and punch 49 are arranged for the blank to be backward extruded to form the third tube section 21 with an inside diameter as determined by the punch 49, somewhat smaller than the inside diameter of the second tube section 19. The punch and die tooling at the stations 16, 18 and 20 is preferably carbide.

It is preferable to configure the punch and die sets so that the inside diameter of the tube sections before drawing of the blank at the steps between successive backward extrusions of the tube sections is about the same or slightly larger, e.g. up to about 0.75 mm, than a diameter of the draw punch at the same axial location from the blank head when the draw punch is seated against the bottom of the pre-drawn blank. In other circumstances, the invention can be successfully practiced without developing a close correspondence of the backward extrusion steps and the contour of the draw punch or tool. Generally, with a succeeding backward extruding punch and die set, the die will have an inside diameter larger than that of the die of the preceding backward extruding punch and die set and the punch will have an outside diameter smaller than that of the punch of the preceding backward extruding punch and die set.

The blank 10 with a tube formed by multiple backward extrusions is transferred to the draw station 22 where it is drawn, for example, through the two draw dies 23 by the draw punch 24 carried on the ram 38. The resulting tube can be considered finished or fully drawn at this station 22.

The foregoing describes forming steps and tooling capable of producing a relatively long cartridge case tube that can be finally or finish drawn without the need to anneal the blank before the final drawing step is performed. It is difficult to precisely characterize a long cartridge case by length (trimmed length) to diameter (outside diameter) ratio, although some analysis of common ammunition would specify a ratio greater than 2½, preferably of about 3 to 1 or greater and, more preferably, a ratio of about 3.2 to 1 or greater. Regardless of length to diameter ratio, the invention of multiple reverse extrusion steps is useful in the manufacture of cartridge cases that would otherwise require annealing before finish drawing to prevent tearing of the tube section.

The process described in reference to FIGS. 1A-1E and FIG. 3, is less involved for purposes of clarity than what can be performed in one or tandem cold-forming machines. The forming machine 14 may have additional workstations with related tooling before, beyond, or intervening those described and/or can include additional forming features in the illustrated stations 16, 18, 20 and 22 and tooling used at these stations. The head 26 of the blank 10 is shown closed and if pierced for a flash hole can be considered effectively closed. In some instances, multiple backward extrusion to avoid tearing failure at a finish draw without a preceding annealing process may be accomplished with two backward extrusions or more than three backward extrusions. It will be understood that the finally drawn blank may be annealed to enable the cartridge tube to be bottled (necked) and/or tapered.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A kit of punches and dies for shaping tubes of long cartridge case blanks in a progressive forming machine, comprising at least three circular punch and die sets, each set being configured to backward extrude a blank tube section, a second one of said sets being proportioned to receive and backward extrude a blank formed in a first one of said sets, and a third one of said sets being proportioned to receive and backward extrude a blank formed in said second set.

2. A kit of punches and dies as set forth in claim 1, wherein the sets are configured and arranged to collectively produce an intermediate blank having three axially extending stepped inside cylindrical surfaces between an open end and an effectively closed end of the blank tube, a small diameter one of said cylindrical surfaces being adjacent the effectively closed end and a large one of said cylindrical surfaces being adjacent the open end.

3. A kit as set forth in claim 1, including a draw punch, the sets of punches and dies being constructed and arranged to form a pre-drawn blank with an inside stepped cylindrical tube with steps between successive backward extrusions being closely adjacent or in contact with the exterior of the draw punch when the draw punch is seated in said pre-drawn blank.

* * * * *